US005404738A

United States Patent [19]

Sekiguchi

[11] Patent Number: 5,404,738

[45] Date of Patent: Apr. 11, 1995

[54] METHOD OF CONTROLLING A HOT STRIP FINISHING MILL

[75] Inventor: Kunio Sekiguchi, Kawagoe, Japan

[73] Assignee: Kabushiki Kaisha Toshiba, Kawagoe, Japan

[21] Appl. No.: 83,532

[22] Filed: Jun. 30, 1993

[30] Foreign Application Priority Data

Jul. 1, 1992 [JP] Japan ..... 4-174309

[51] Int. Cl.[6] ..... B21B 1/26

[52] U.S. Cl. ..... 72/17; 72/205; 72/240

[58] Field of Search ..... 72/14, 17, 234, 240, 72/205

[56] References Cited

U.S. PATENT DOCUMENTS

| | | | |
|---|---|---|---|
| 3,318,125 | 5/1967 | Pullen | 72/14 |
| 4,162,624 | 7/1979 | Morooka et al. | 72/17 |
| 4,335,435 | 6/1982 | Miura | 72/240 |
| 4,507,946 | 4/1985 | Koyama et al. | 72/17 |

FOREIGN PATENT DOCUMENTS

| | | | |
|---|---|---|---|
| 2944035 | 5/1980 | Germany . | |
| 3303829 | 8/1983 | Germany . | |
| 0114513 | 9/1981 | Japan | 72/17 |
| 0138510 | 8/1983 | Japan | 72/240 |
| 3-47934 | 7/1991 | Japan . | |

OTHER PUBLICATIONS

Proceeding of 36th congress of the Japan Society of Technology of Plasticity, No. 146, K. Sekiguchi, et al., Oct. 6, 1985, pp. 181–184.

*Primary Examiner*—Lowell A. Larson
*Assistant Examiner*—Thomas C. S. Schoeffler
*Attorney, Agent, or Firm*—Oblon, Spivak, McClelland, Maier & Neustadt

[57] ABSTRACT

Continuous rolling is conducted by interposing loopers respectively between a plurality of successive stands and connecting a rear end of a preceding bar to a top end of a next bar. Roll gaps of the respective stands are each controlled by thickness control units. Interstand mass flow variations are each controlled by mass flow control units. Looper heights are controlled by looper height control units. Further, interstand tensions are controlled by looper tension control units. If no looper is provided, the interstand tensions are controlled by looperless control units. A flying thickness change control unit tracks a connecting point. The flying thickness change control unit switches over looper tension control and looperless control and changes a reference tension and a reference looper angle so that tensile and flexural forces are not applied to this connecting point.

3 Claims, 7 Drawing Sheets i
(i+1)
1
2
8
Q
9a
LOOPER TENSION CONTROL

LOOPERLESS CONTROL

LOOPERLESS CONTROL

LOOPERLESS CONTROL

LOOPERLESS CONTROL

LOOPER TENSION CONTROL

METHOD OF CONTROLLING A HOT STRIP FINISHING MILL

BACKGROUND OF THE INVENTION

1. Field of the Invention

The present invention relates to a method of controlling a hot strip finishing mill for effecting continuous rolling by interposing loopers respectively between a plurality of consecutive stands and connecting a rear end of a preceding bar (a rolled material undergoing a rolling process at the present) to a top end of a next bar (a rolled material to be rolled next).

2. Related Background Art

A practice widely adopted by cold tandem rolling mills is a so-called flying thickness change wherein a pass schedule is changed without stopping the mill during a rolling process, and products having the same size or different sizes are continuously rolled. It is of importance in this flying thickness change to reduce an off-gauge length to the greatest possible degree and simultaneously prevent an occurrence of troubles such as a rupture of a strip by properly changing set values of a roll peripheral speed and a roll gap of each stand when a size change point passes through the mill.

A method of changing the above-mentioned roll gap and roll peripheral speed is disclosed as a method of controlling tandem mills in Japanese Patent Post-Exam Publication No. 55-11923. According to this method, there are predetermined roll peripheral speeds and roll gaps during a period for which the size change point passes through each stand and after the size change point has passed through the stand. These roll gaps and roll peripheral speed are each stored as set values. The roll gaps and the roll peripheral speeds are changed to these set values at predetermined timings by tracking the size change point.

On the other hand, a flying change technique in hot rolling mills appears on pp. 181~184 of, e.g., a collection of pre-manuscripts written by Hiroshi Kosuga, Kunio Sekiguchi and others, titled [Flying Gauge Change Control For Hot Strip Finishing Mill] in the 36th Plastic Working Association's Lecture Meeting, Oct. 6, 1985. According to this technique, the roll gap is changed by varying a reference thickness under a gauge meter AGC of each stand, and the roll peripheral speed is changed under optimum mass flow control.

The hot strip finishing mill includes rolling stands 1~7 disposed at predetermined spacings. Rolled materials 8 are each rolled to a target thickness on the delivery side of each stand. Further, mechanical loopers 9~14 are provided between the respective stands. The looper raises the rolled material 8 up to a certain height and, besides, gives a predetermined tension to the rolled material 8. The flying change in this hot strip finishing mill is defined as a technique of performing continuous rolling by connecting a rear end of a preceding bar to a top end of a next bar (a connecting point thereof is indicated by Q).

Herein at the connecting portion, as illustrated in FIG. 7, the preceding bar and the next bar on the entry side of a first stand are generally different in terms of a steel grade, a thickness H and a width W. Besides, the sizes are also different on the delivery side of a final seventh stand. Table 1 shows one example of pass schedule of the preceding bar and the next bar in that case.

TABLE 1

| | F1 Ent. | F1 | F2 | F3 | F4 | F5 | F6 | F7 |
|---|---|---|---|---|---|---|---|---|
| Preceding Bar (mm) | 35.0 | 18.1 | 10.8 | 6.6 | 4.3 | 3.0 | 2.2 | 1.8 |
| Next Bar (mm) | 30.0 | 14.0 | 8.0 | 4.7 | 3.0 | 2.0 | 1.5 | 1.2 |

In this example, it is required that the thickness on the delivery side of each stand be changed in front and in rear of the connecting point. Based on a changing method thereof, as shown in FIG. 8, the thickness is changed for a certain time (change time), with the connecting point being centered. This change time is determined by an upper limit of a change speed of set values of the roll gap and the roll peripheral speed or a limit to secure an operating stability. The change time is 0.5~2.0 seconds according to actual results obtained so far. Even within this change time, a mass flow balance between the mutual stands has to be kept, and the stable operation also has to be actualized.

Now, it is assumed that an interstand distance is set to 5 m, and an interstand rolled material speed is set to 10 m/s. If the change time is 1 second or more, a size change portion is located astride a plurality of stands, and it follows that the set values of the plurality of stands are simultaneously changed. Nonetheless, in a state where the sizes of the rolled materials vary momentarily on the entry and delivery sides of the plurality of stands, it is almost impossible to accurately estimate the set values of the roll peripheral speed and of the roll gap for keeping the mass flow balance.

Under such circumstances, the cold tandem rolling mills are constructed so that the size change potion is not located astride the plurality of stands by reducing the rolling speed when changing the size. According to the hot strip finishing mill wherein a temperature of the rolled material on the delivery side of the mill is required to be held at a target value, however, the situation is such that the rolling speed can not be reduced.

On the other hand, the flying thickness change control in the hot strip finishing mill can not be applied to such processing that the rolled materials different in terms of the steel grade, the thickness and the width are connected on the entry side of the mill, or continuous rolling is conducted with different strip sizes on the delivery side of the finishing mill.

Note that a thinkable method of connecting the preceding and next bars may involve the use of welding, press-fitting, engaging, etc.. However, a tensile or flexural strength at the connecting point is, it is considered, still smaller than at points other than the connecting point. As illustrated in FIG. 6, the loopers are disposed between the stands, and the rolled material is raised by this looper to produce a tension. In this case, there exists a possibility in which the flexure and the tension are given to the connecting point enough to rupture the connecting point.

SUMMARY OF THE INVENTION

It is a primary object of the present invention, which has been devised to obviate the foregoing problems, to provide a method of controlling a hot strip finishing mill that is capable of effecting a simple and stable flying thickness change even when a size change portion is located astride a plurality of stands in the case of continuously rolling the rolled materials to different strip sizes on the delivery side of the finishing mill by connecting the rolled materials exhibiting a different steel grade, thickness and width on the entry side of the finishing mill.

It is another object of the present invention to provide a method of controlling a hot strip finishing mill that is capable of surely preventing a strip rupture at a connecting point which is easy to cause during a flying thickness change.

To accomplish the objects given above, according to one aspect of the present invention, there is provided a method of controlling a hot strip finishing mill for effecting continuous rolling by locating loopers between a plurality of consecutive stands and connecting a rear end of a preceding bar to a top end of a next bar, the method comprising the steps of: calculating a thickness on the delivery side of each stand by use of actual values of a rolling force and a roll gap; controlling the roll gap of each stand so that the delivery-side thickness coincides with a reference thickness; calculating an interstand mass flow variation by use of a mass flow variation on the delivery side of an upstream stand and a mass flow variation on the entry side of a downstream stand of two adjacent stands; controlling a roll peripheral speed of the upstream stand to make the interstand mass flow variation zero; controlling a speed of a looper driving motor so that a detected angle of the looper coincides with a predetermined reference angle until a connecting point between the preceding bar and the next bar reaches a position just before the upstream stand with respect to the looper and after passing through the downstream stand; simultaneously detecting a tension of a rolled material by use of a load undergone by the looper; controlling the roll peripheral speed of the upstream stand with respect to the looper so that the tension coincides with a reference tension during steady-state rolling; controlling a speed of a looper driving motor so that a looper roll coincides with a reference angle prescribed so as not to contact the rolled material until the connecting point passes through the downstream stand after the connecting point has reached the position just before the upstream stand with respect to the looper; detecting a tension of the rolled material on the basis of an actual value of rolling torque and the actual value of the rolling force of the upstream stand of the two adjacent stands; and controlling the roll peripheral speed of the upstream stand so that a detected tension coincides with a reference tension decreasing from a magnitude during steady-state rolling down to zero or a trace magnitude until the connecting point reaches the upstream stand after the connecting point has reached the position just before the upstream stand and so that the detected tension coincides with zero or a trace reference tension until the connecting point passes through the downstream stand after the connecting point has reached the upstream stand.

According to the present invention, a delivery-side thickness is controlled per stand, and, at the same time, an interstand mass flow variation is made zero by controlling the roll peripheral speed of the upstream stand. Hence, there is no necessity for predetermining the set values of the roll peripheral speed and of the roll gap during the flying change. The flying change can be performed easily and stably even when the size change point is located astride the plurality of stands. Further, the looper is made to escape so that a looper roll does not contact the rolled material until the connecting point passes through the downstream stand after the connecting point has reached the position just before the upstream stand with respect to the looper. Simultaneously, the tension is controlled based on the actual values of the rolling torque and of the rolling force of the upstream stand by a switchover to the tension control which employs the load acting on the looper. Besides, the reference tension is made substantially zero until the connecting point passes through the downstream stand after the connecting point has passed through the upstream stand. It is therefore feasible to surely prevent the strip rupture at the connecting point which is easy to take place during the flying thickness change.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENT

The present invention will hereinafter be described in detail by way of an illustrative embodiment.

Figure 1:
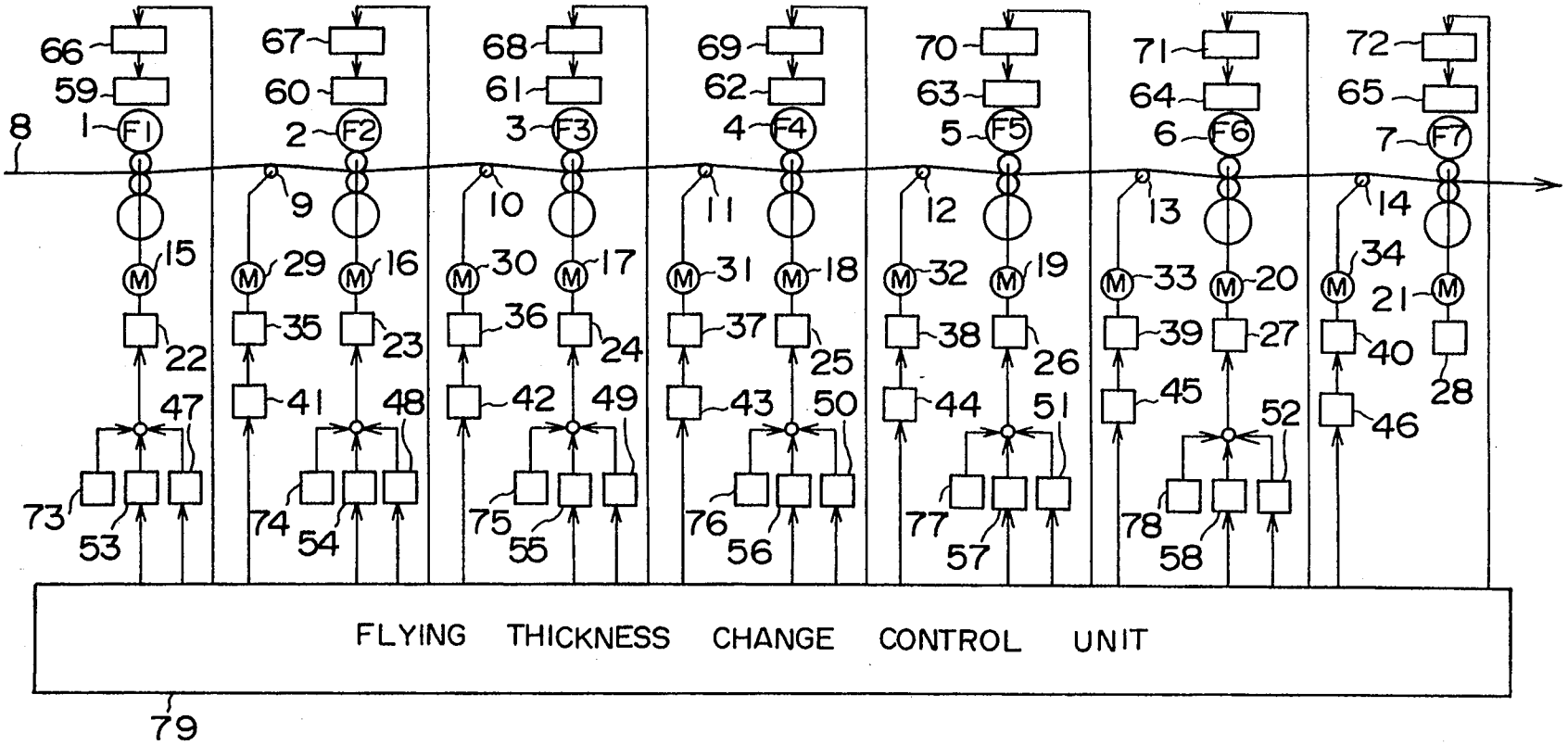
FIG. 1 is a block diagram illustrating a construction of a whole apparatus for embodying the present invention in combination with a rolling system.

FIG. 1 is a block diagram illustrating a construction of an apparatus for controlling a hot strip finishing mill for embodying this invention in combination with a rolling system. Referring to the same Figure, a rolled material 8 is rolled to a target size by rolling stands 1~7 arranged at predetermined spacings. Provided in this case are loopers 9~14 for giving a tension to the rolled material by raising the rolled material up to a predetermined height between the stands. Main driving motors 15~21 for driving rolls on the respective stands are individually equipped with speed control units 22~28. Looper driving motors 29~34 for driving loopers 9~14 respectively include speed control units 35~40. The motors 29~34 further include looper height control units 41~46 for respectively calculating a reference speed of the looper driving motor in accordance with a reference angle of the looper and giving the reference speed to the speed control units 35~40.

Provided further are looper tension control units 47~52 for detecting a tension of the rolled material from a load acting on the looper and controlling a roll peripheral speed of an upstream stand so that this tension coincides with a reference tension. Provided also are looperless control units 53~58 for detecting an interstand tension of the rolled material from a rolling force of the upstream stand and an actual value of a rolling torque without using the looper load and for controlling the roll peripheral speed of the upstream stand in a looperless state (where the looper does not substantially exist by lowering the looper under a pass line) so that this detected tension coincides with the reference tension. On the other hand, there are provided roll gap control units 59~65 for controlling roll gaps of the respective stands. Provided also are thickness control units 66~72 for detecting a thickness on the delivery side of the stand from a rolling force and an actual roll gap value by use of a gauge meter method and controlling the roll gap so that this detected thickness coincides with the reference thickness.

Prepared further are mass flow control units 73~78 for calculating an interstand mass flow variation from a mass flow variation on the delivery side of an upstream stand as well as from a mass flow variation on the entry side of a downstream stand of two adjacent stands and for controlling a roll peripheral speed of the upstream stand so that this mass flow variation becomes zero. There is also prepared a flying thickness change control unit 79 for changing the reference thickness and the reference looper angle, switching over the looper tension control units and the looperless control units and also changing the reference tension at predetermined timings while tracking a connecting point between a preceding bar and a next bar.

In this apparatus for controlling the hot strip finishing mill, the control systems corresponding to the rolling stands 1~6 other than the rolling stand 7 serving as a pivot stand are all constructed the same. Besides, the control systems corresponding to the loopers 9~14 are all constructed the same. Detailed explanations will be therefore centered particularly on the operations of the control system of the first stand and of the control system for the looper interposed between the first and second stands.

Figure 2:
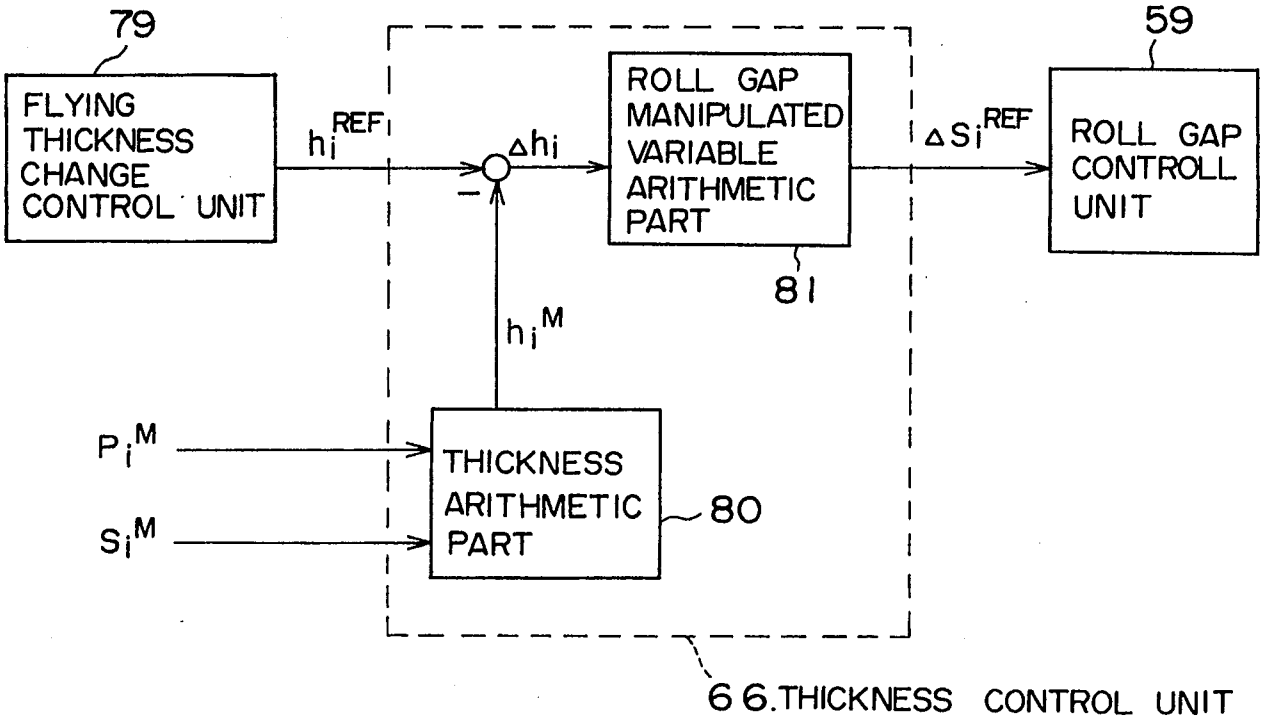
FIG. 2 is a block diagram fully illustrating a construction of the principal portion of the apparatus for embodying the present invention.

To start with, a method of changing the roll peripheral speed and the roll gap will be explained with reference to FIG. 2. FIG. 2 illustrates the roll gap control unit 59, the thickness control unit 66 and the flying thickness change control unit 79. The thickness control unit 66 among them includes a thickness arithmetic part 80 and a roll gap manipulated variable arithmetic part 81. The control unit 79 herein outputs a reference thickness $h_i^{REF}$ on the delivery side of an ith (i=1) stand. Based on an actual rolling force value $P^{M_i}$ and an actual roll gap value $S^{M_i}$, the thickness arithmetic part 80 calculates an actual thickness value $h^{M_i}$ on the delivery side of the ith stand by use of the known gauge meter method which will be shown as follows:

$$h^{Mi} = S^{Mi} + \frac{P^{Mi}}{M_i} \tag{1}$$

where $M_i$: mill constant of the ith stand.

The roll gap manipulated variable arithmetic part 81 calculates a difference $\Delta h_i$ between the reference thickness $h_i^{REF}$ on the delivery side of the ith stand and the actual thickness value $h^{M_i}$ on the delivery side thereof. This arithmetic part 81 further calculates such a roll gap manipulated variable $\Delta S_i^{REF}$ as to make this difference $\Delta h_i$ zero by executing a PI operation with respect to this difference $\Delta h_i$. The arithmetic part 81 then imparts this roll gap manipulated variable to the roll gap control unit 59. The roll gap control unit 59 changes a roll gap in accordance with the roll gap manipulated variable $\Delta S_i^{REF}$. The delivery-side thickness is thereby controlled to a target thickness.

Note that the flying thickness change control unit 79 tracks the connecting point and effects a changeover from a reference thickness of the preceding bar to a reference thickness of the next bar at a predetermined change time just before this connecting point reaches the stand, i.e., from a timing when a size change point reaches the stand.

Next, a change in the roll speed will be explained. If an ith stand delivery-side speed $V_{0i}$ is always equal to an (i+1)th stand entry-side speed $V_{E(i+1)}$ with respect to the two adjacent stands i and i+1, a stand-to-stand tension between the ith and (1+1)th stands does not fluctuate. A mass flow balance is dynamically kept. The roll peripheral speed is changed based on this concept in accordance with the present embodiment.

More specifically, the ith stand delivery-side speed $V_{0i}$ and the (i+1)th stand entry-side speed $V_{E(i+1)}$ are expressed by the following formulae:

$$V_{0i} = V_{Ri} \cdot (1+f_i) \tag{2}$$

$$V_{E(i+1)} = V_{R(i+1)} \cdot (1-b_{i+1}) \tag{3}$$

where $V_{Ri}$: roll peripheral speed of the ith stand,
$V_{R(i+1)}$: roll peripheral speed of the (i+1)th stand,
$f_i$: forward slip of the ith stand, and
$b_{i+1}$: backward slip of the (i+1)th stand.

Now, if equal even in a state where $V_{0i}$ varies by $\Delta V_{0i}$ while $V_{E(i+1)}$ varies by $\Delta V_{E(i+1)}$, the following formula is to be obtained:

$$(V_{Ri}+\Delta V_{Ri}) \cdot (1+f_i+\Delta f_i) = (V_{R(i+1)}+\Delta V_{R(i+1)}) \cdot (1-b_{i+1}-\Delta b_{i+1}) \tag{4}$$

This formula (4) is developed, and a term of a product of the mutual variations is ignored. Further, the left side is divided by the formula (2), while the right side is divided by the formula (3), thereby obtaining the following formula:

$$\frac{\Delta V_{Ri}}{V_{Ri}} = \frac{\Delta V_{R(i+1)}}{V_{R(i+1)}} - \frac{\Delta f_i}{1+f_i} - \frac{\Delta b_{i+1}}{1-b_{i+1}} \tag{5}$$

Besides, the mass flow on the entry side of the (i+1)th stand roll bite is equal to a mass flow on the delivery side thereof, and hence the following formula is established:

$$W_{i+1} \cdot H_{i+1} \cdot V_{R(i+1)} \cdot (1-b_{i+1}) = w_{i+1} \cdot h_{i+1} \cdot V_{R(i+1)} \cdot (1+f_{i+1}) \tag{6}$$

where $W_{i+1}$: entry-side width of the (i+1)th stand,
$H_{i+1}$: entry-side thickness of the (i+1)th stand,
$w_{i+1}$: delivery-side width of the (i+1)th stand, and
$h_{i+1}$: delivery-side thickness of the (i+1)th stand.

If an equation is established even when the respective variables in the formula (6) change as in the above-mentioned case, a variation rate of the backward slip of the (i+1)th stand is given by the following formula:

$$-\frac{\Delta b_{i+1}}{1-b_{i+1}} = \frac{\Delta w_{i+1}}{w_{i+1}} - \frac{\Delta W_{i+1}}{W_{i+1}} + \frac{\Delta h_{i+1}}{h_{i+1}} - \tag{7}$$

-continued $$\frac{\Delta H_{i+1}}{H_{i+1}} + \frac{\Delta f_{i+1}}{1 + f_{i+1}}$$

The roll bite entry- and delivery-side width variation rates in the first and second terms of the right side in this formula (7) are small enough to ignore exclusive of the strip edge portion. The formula (5) can be therefore modified as follows:

$$\frac{\Delta V_{Ri}}{V_R^{Li}} = \frac{\Delta V_{R(i+1)}}{V_R^{Li+1}} - \frac{\Delta H_{i+1}}{H^{Li+1}} + \frac{\Delta h_{i+1}}{h^{Li+1}} - \frac{\Delta f_i}{1 + f^{Li}} + \frac{\Delta f_{i+1}}{1 + f^{Li+1}} \quad (8)$$

In accordance with this embodiment, the roll peripheral speed is changed at the connecting point by momentarily calculating the roll peripheral speed of the ith stand by the formula (8) and controlling it. The suffix L attached to the denominator of each term in the formula (8) implies a value in a normal rolled state, while the numerator is a variation from the value in this normal rolled state. The value in the normal rolled state typically involves the use of a calculated value or an actual value just before starting the control in accordance with the formula (8).

The first term of the right side in the formula (8) given above is a successive controlled variable with respect to the variation in the (i+1)th stand roll peripheral speed. The second term of the right side is a thickness variation rate on the entry side of the (i+1)th stand. The numerator $\Delta H_{i+1}(t)$ at a timing t is calculated by the following formulae (9) and (10). The (i+1)th stand entry-side thickness $H^{M}_{i+1}(t)$ in the formula (10) is obtained by delaying a detected value of a thickness gauge or the ith stand delivery-side thickness obtained by the formula (1) down to the (i+1)th stand.

$$\Delta H_{i+1}(t) = H^{M}_{i+1}(t) - H^{L}_{I+1} \quad (9)$$

$$H^{M}_{i+1}(t) = h^{M}_{i}(t - T_{di}) \quad (10)$$

where t: present time, and

Tdi: rolled material transfer time from the ith or ith stand delivery-side thickness gauge to the (i+1)th stand.

Further, the third term of the right side in the formula (8) is an (i+1)th stand delivery-side thickness variation rate, and a delivery-side thickness variation is calculated by the following formulae (11), (12):

$$\Delta h_{i+1} = h^{Mi+1} - h^{Li+1} \quad (11)$$

$$h^{Mi+1} = S^{Mi+1} + \frac{P^{Mi+1} - g_{t(i+1)} \cdot (t_b^{Mi+1} - t_b^{Li+1})}{M_{i+1}} \quad (12)$$

where $S^{M}_{i+1}$: actual roll gap value of the (i+1)th stand, $P^{M}_{i+1}$: actual rolling force value of the (i+1)th stand, $g_{t(i+1)}$: influence coefficient of a backward tension with respect to the (i+1)th stand rolling force, $t_b^{Mi+1}$: backward actual tension value of the (i+1)th stand, and $t_b^{Li+1}$: backward reference tension value of the (i+1)th stand.

Further, the fourth term of the right side in the formula (8) is a variation rate of the ith stand forward slip, while a variation in the forward slip is calculated by the following formula (13):

$$\Delta f_i = g_{fHi} \cdot \Delta H_i + g_{fhi} \cdot \Delta h_i + g_{fki} \cdot \Delta k_i \quad (13)$$

where $g_{fHi}$: influence coefficient of the entry-side thickness with respect to the ith stand forward slip, $g_{fhi}$: influence coefficient of the delivery-side thickness with respect to the ith stand forward slip, $g_{fki}$: influence coefficient of a resistance-to-deformation with respect to the ith stand forward slip, and $\Delta k_i$: variation in the ith stand resistance-to-deformation.

$\Delta H_i$ and $\Delta h_i$ in this formula (13) are values obtained by respectively applying the formulae (9) and (11) with respect to the ith stand. Further, the resistance-to-deformation variation $\Delta k_i$ is calculated from, e.g., the actual rolling load value by use of the following formulae (14) and (15):

$$\Delta k_i = k^{Mi} - k^{Li} \quad (14)$$

$$k^{Mi} = \frac{p^{Mi}}{W_i \cdot L_{di} \cdot Q_\pi} + \alpha \cdot t_b^{Mi} + \beta \cdot t_f^{Mi} \quad (15)$$

where $\alpha$ and $\beta$ are the coefficients, $L_{di}$ is the contact arc length, and $Q_{pi}$ is the rolling force coefficient. These values and the influence coefficients $g_{ti+1}$, $g_{fHi}$ and $g_{fki}$ used in the formulae (12) and (13) are calculated by a known rolling model formula.

Further, the fifth term of the right side in the formula (8) is the variation rate of the (i+1)th stand forward slip and also obtained by applying the formula (13) to the (i+1)th stand.

As explained above, in accordance with this embodiment, the thickness on the delivery side of each stand is changed from the preceding bar thickness to the next bar thickness by varying the reference thickness of the thickness control unit 66 at the connecting point. Simultaneously, the mass flow variation between the adjacent stands is obtained from the actual rolling value. The roll peripheral speed manipulated variable for keeping the mass flow balance is calculated and controlled, thereby performing a flying change. Therefore, even when the size change portion is located astride a plurality of stands, the flying change can be conducted with stability.

Figures 3A, 3B, 3C, 3D, 3E, 3F:
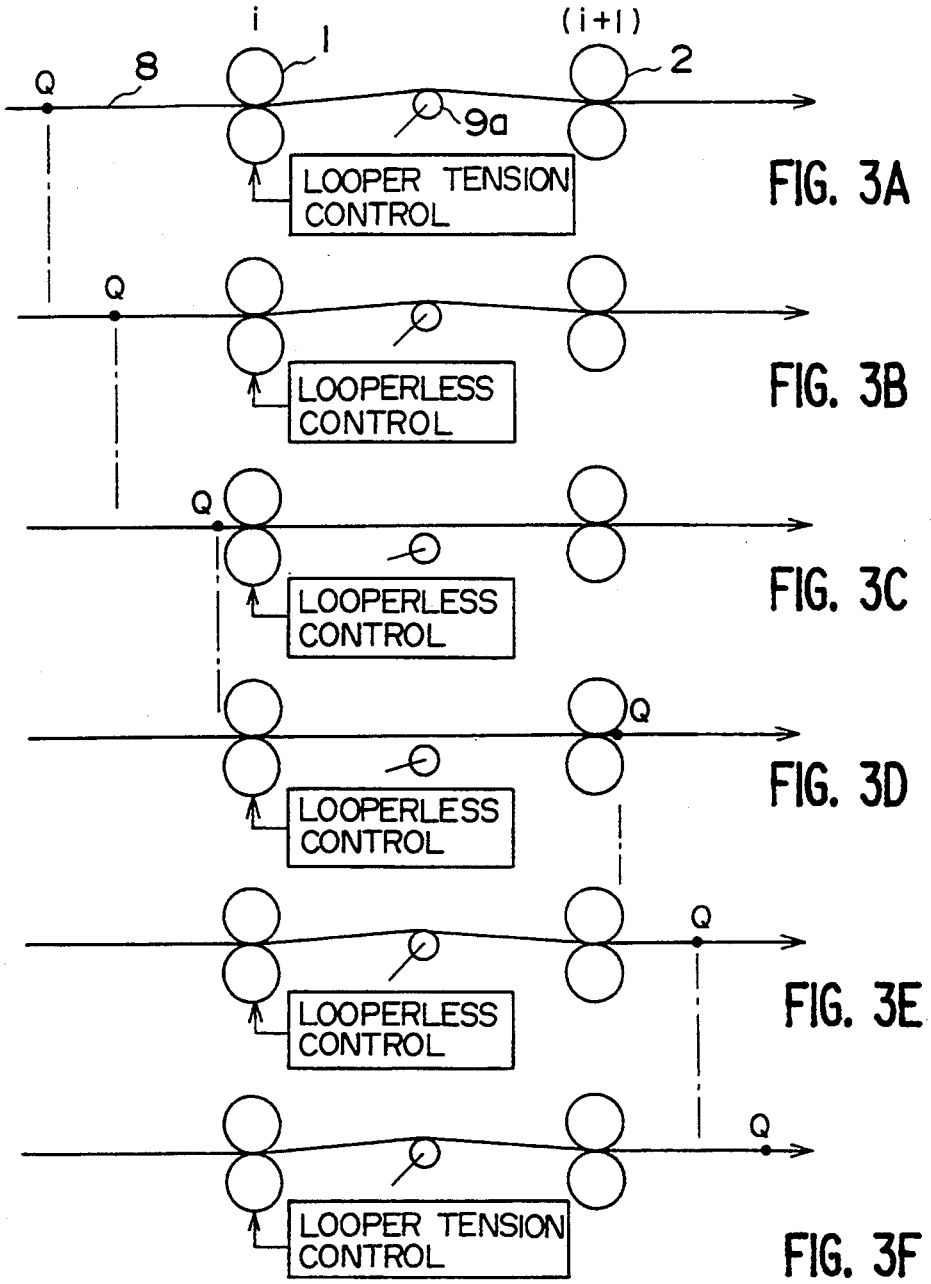
FIGS. 3(*a*)–3(*f*) explain the detailed operation of the apparatus for embodying the present invention.
Figure 4:
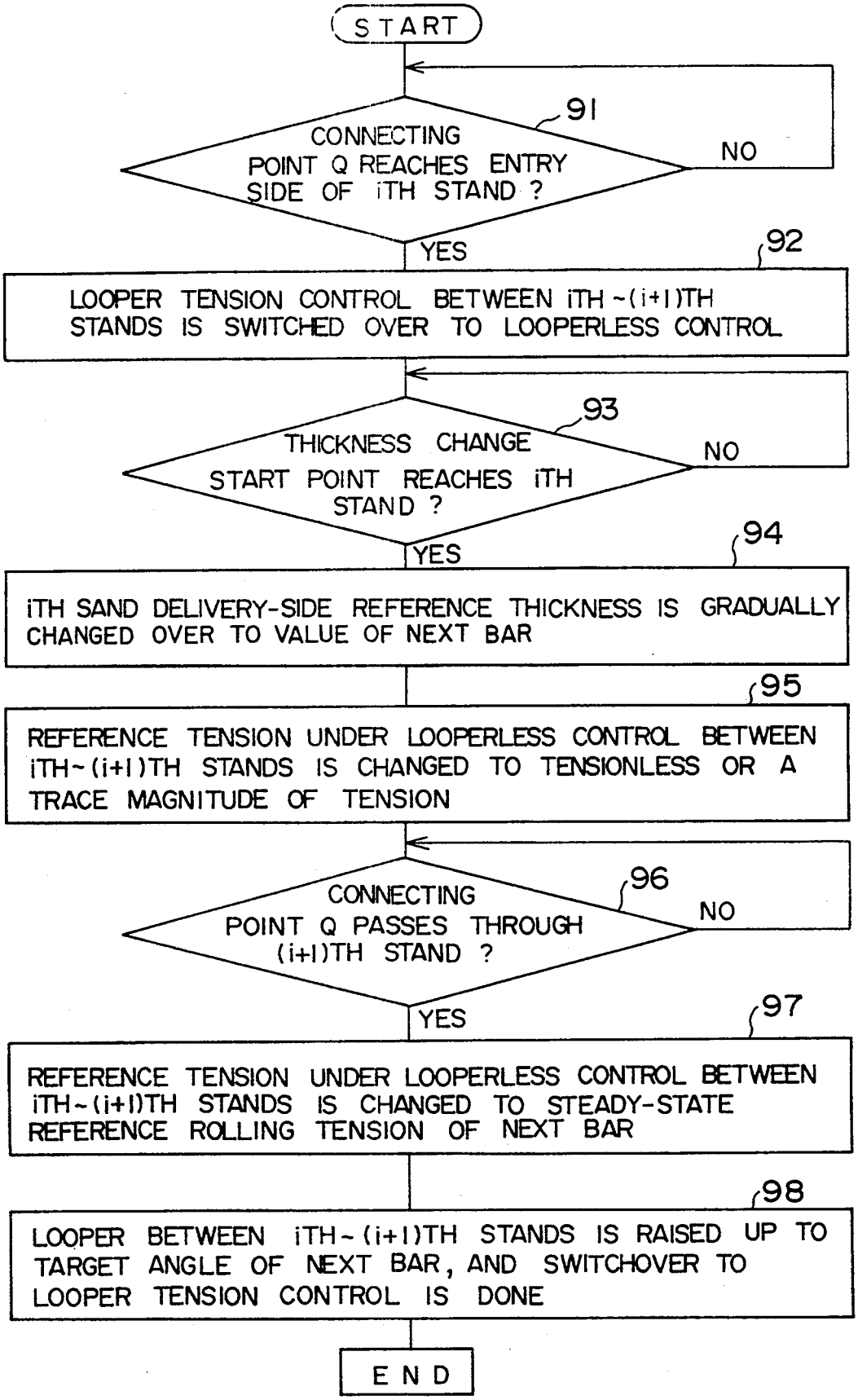
FIG. 4 is a flowchart of assistance in explaining a method according to the present invention.

Next, the control over an interstand tension will be explained with reference to FIGS. 3 and 4. FIG. 3 illustrates a looper 9 and two sets of arbitrary stands i and i+1 of the finishing mill for rolling the rolled material 8. FIG. 3(*a*) shows a state where connecting point Q is positioned far away from the ith stand, and so-called looper tension control is effected, with a tension between the ith and (i+1)th stands involving the use of a load undergone by the looper. FIG. 3(*b*) illustrates a state where the connecting point Q approaches the entry side of the ith stand. The flying thickness change control unit 79 checks whether or not the connecting point Q reaches the entry side of the ith stand (FIG. 4: step 91). When the connecting point Q approaches the entry side of the ith stand, an ith stand torque arm coefficient needed for detecting the actual tension value under the looperless control is calculated by the following formula. Thereafter, a tension control system between the ith and (i+1)th stands is switched over from the looper tension control to the looperless control (step 92).

$$A_{Oi} = \frac{G^{Mi} - \delta_i \cdot T^{Mi-1} + \gamma_i + T^{Mi}}{P^{Mi} - \beta_i \cdot T^{Mi-1} + \alpha_i + T^{Mi}} \quad (16)$$

where

T: interstand tension, $A_0$: torque arm coefficient,

G: rolling torque,

P: rolling force, and $\alpha$, $\beta$, $\gamma$, $\delta$: constants.

At this time, the looper is held at a target looper angle when rolling the preceding bar. At the same time, the reference tension under the looperless control is set to a target tension of the preceding bar. After being changed to the looperless control, as shown in FIG. 3(*c*), there is monitored how the connecting point Q reaches the ith stand (step 93). The looper is lowered under the pass line during a period for which reaching thereof is attained, thus establishing a state (looperless state) where the rolled material can not be raised by the looper. Then, when a thickness change start point comes to the ith stand, the ith stand delivery-side reference thickness is gradually changed over to the reference value of the next bar (step 94). Further, the looperless control reference tension between the ith and (i+1)th stands is changed to zero or a trace value (step 95), with the result that a large tension does not act on the connecting point. The rolling action continues until the connecting point Q passes through the (i+1)th stand in this state. As illustrated in FIG. 3(*d*), after the connecting point Q has passed through the (i+1)th stand, the looperless control reference tension between the ith and (i+1)th stands is varied to steady-state rolling reference tension of the next bar (steps 96 and 97). After the connecting point has passed through the ith stand, as illustrated in FIG. 3(*e*), the looper is raised up to a target angle of the next bar. Thereafter, as shown in FIG. 3(*f*), the tension control system between the ith and (i+1)th stands is switched over from the looperless control to the tension control (step 98). At this moment, the reference tension under the looper tension control is also a target tension of the next bar.

Figure 5:
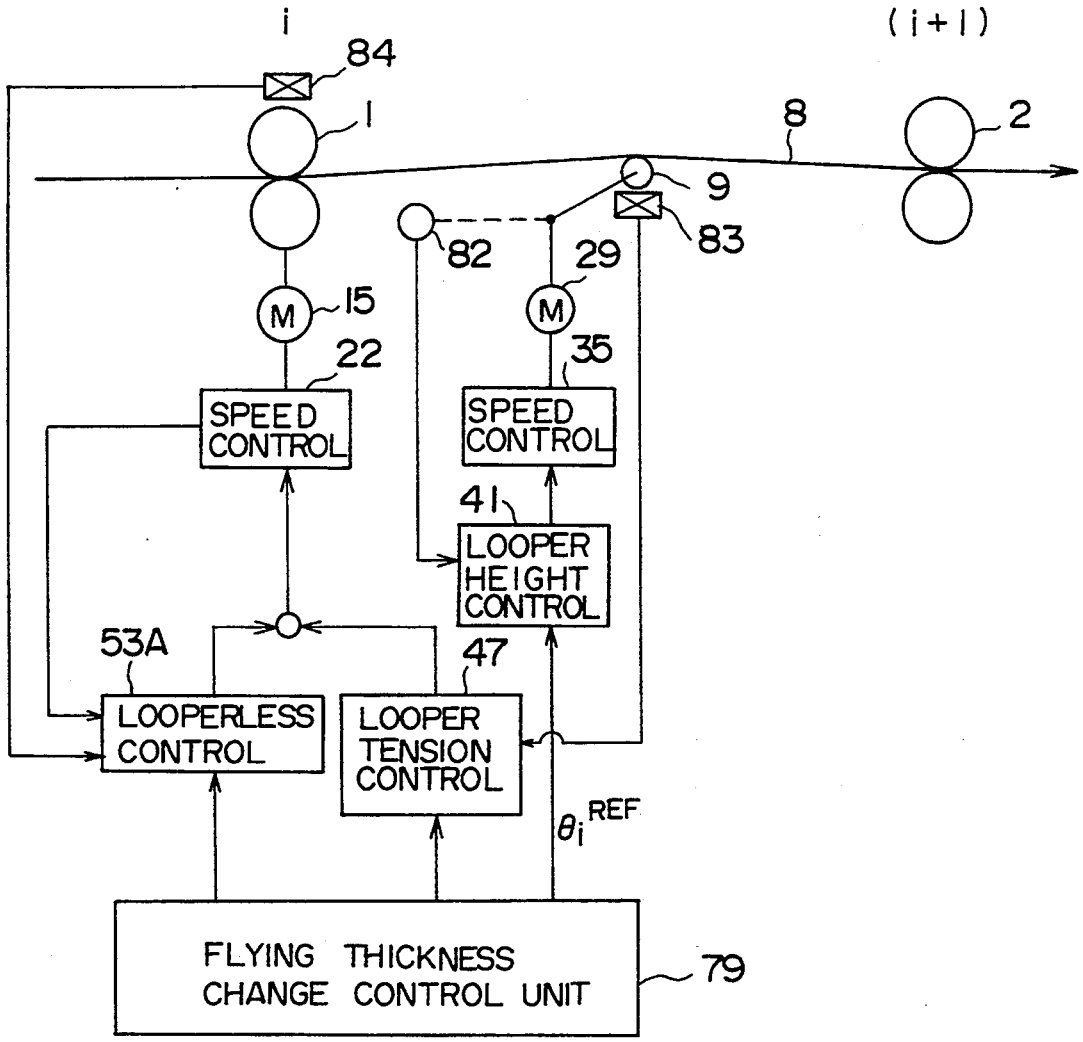
FIG. 5 is a block diagram fully showing a construction of the principal portion of the apparatus for embodying the present invention.
Figure 6:
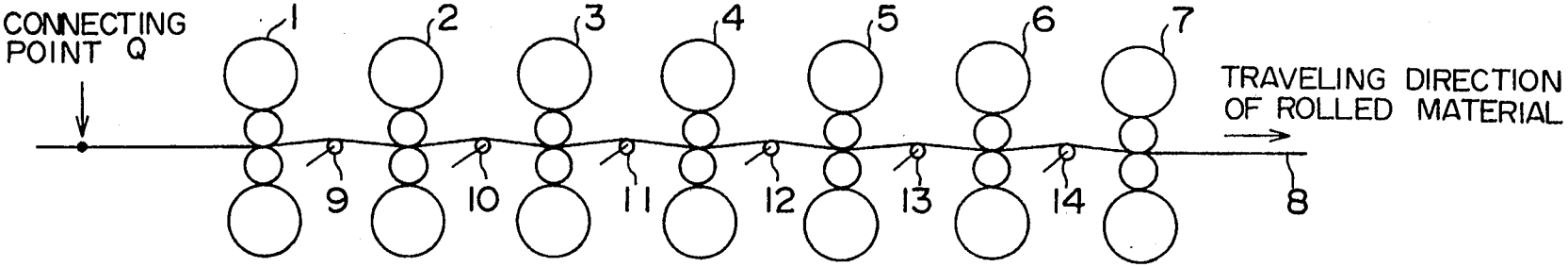
FIG. 6 is an explanatory diagram showing a typical flying rolling process.
Figure 7:
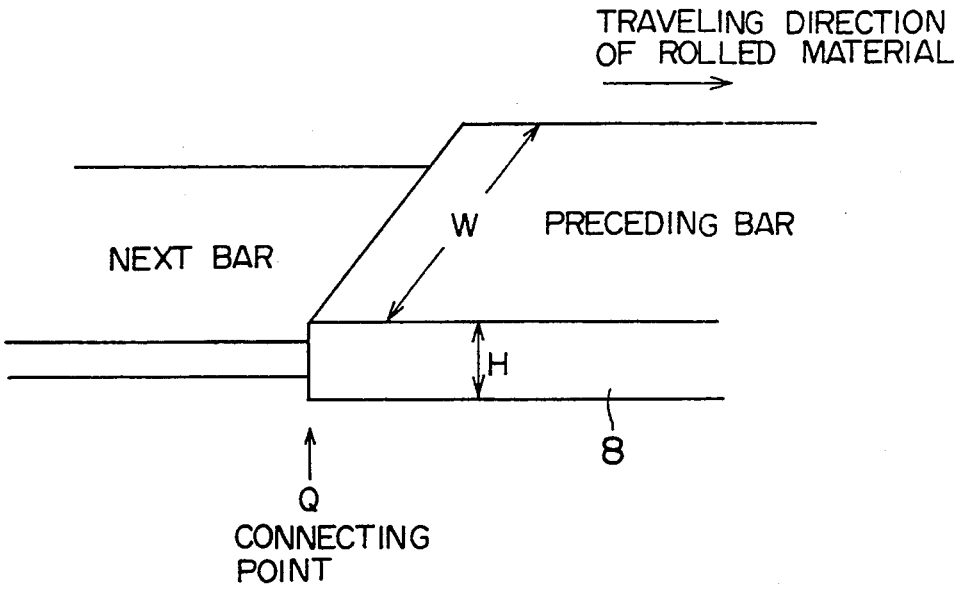
FIG. 7 is a perspective view illustrating a profile of a rolled material to which the flying rolling process is applied.
Figure 8:
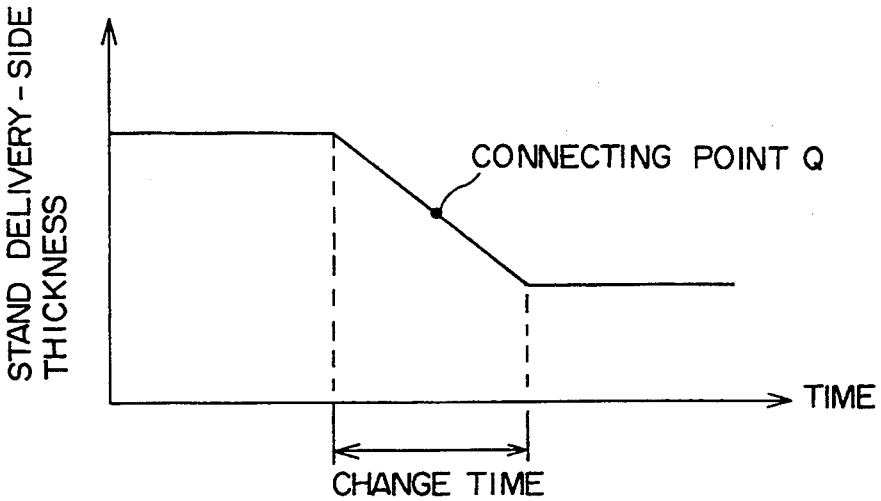
FIG. 8 is an explanatory diagram showing the rolling at a connecting point in the flying rolling process.

FIG. 5 fully illustrates the control system for actualizing the control described above. In the same Figure, the speed control unit 22 controls a speed of the main driving motor 15 for driving the ith stand. Given to the looperless control unit 53 are an actual rolling torque value calculated by this speed control unit 22, a detected value of a rolling force detector 84 and a reference tension of the flying thickness change control unit 79. This looperless control unit 53 calculates such an ith stand roll peripheral speed manipulated variable that a difference from an actual tension value $T_i$ becomes zero in accordance with the following formula. This control unit 53 then imparts it to the speed control unit 22. The stand roll peripheral speed manipulated variable is calculated and given to the speed control unit 22.

$$T_i = \frac{G^{Mi} - A_{Oi} \cdot P^{Mi} - A_{Oi} \cdot \beta_i \cdot T^{Mi-1} - \delta_i \cdot T^{Mi-1}}{A_{Oi} \cdot \alpha_i - \gamma_i} \quad (17)$$

Further, the looper tension control unit 47 calculates such an ith stand roll peripheral speed manipulated variable as to make zero a difference between the interstand reference tension given from the flying thickness change control unit 79 and the actual tension value detected from the load exerted on the looper 9. This control unit 47 imparts it to the speed control unit 22.

Moreover, a looper angle is detected by an angle detector 82. The looper height control unit 41 calculates a motor speed manipulated variable to make zero a difference between this detected angle and a reference angle $Q_i$REF given from the flying thickness change control unit 79. The looper height control unit 41 imparts it to the speed control unit 35. The speed control unit 35 controls a speed of the looper driving motor 29 in accordance with this manipulated variable.

On the other hand, the flying thickness change control unit 79 gives the above-mentioned interstand reference tension and reference angle. In addition, the control unit 79 follows up a position of the connecting point Q and, as explained referring to FIG. 3, switches over the looper tension control and the looperless control, changes the reference looper angle and the interstand reference tension at the predetermined timings. It is thus possible to prevent a rupture of the strip at the connecting point which is weak in terms of a tensile or flexural strength.

It is apparent that, in this invention, a wide range of different working modes can be formed based on the invention without deviating from the spirit and scope of the invention. This invention is not restricted by its specific working modes except being limited by the appended claims.

What is claimed is:

1. A method of controlling a hot strip finishing mill for effecting continuous rolling by locating loopers between a plurality of consecutive stands and connecting a rear end of a preceding bar to a top end of a next bar, comprising the steps of:

calculating a thickness on the delivery side of said each stand by use of actual values of a rolling force and a roll gap;

controlling said roll gap of said each stand so that said delivery-side thickness coincides with a reference thickness;

calculating an interstand mass flow variation by use of a mass flow variation on the delivery side of an upstream stand and a mass flow variation on the entry side of a downstream stand of two adjacent stands;

controlling a roll peripheral speed of said upstream stand to make said interstand mass flow variation zero;

controlling a speed of a looper driving motor so that a detected angle of said looper coincides with a predetermined reference angle until a connecting point between said preceding bar and said next bar reaches a position just before said upstream stand with respect to said looper and after passing through said downstream stand;

simultaneously detecting a tension of a rolled material by use of a load undergone by said looper;

controlling said roll peripheral speed of said upstream stand with respect to said looper so that said tension coincides with a reference tension during steady-state rolling;

controlling a speed of a looper driving motor so that a looper roll coincides with a reference angle prescribed so as not to contact said rolled material until said connecting point passes through said downstream stand since after connecting point has reached the position just before said upstream stand with respect to said looper;

detecting a tension of said rolled material on the basis of an actual value of rolling torque and the actual value of said rolling force of said upstream stand of said two adjacent stands; and controlling said roll peripheral speed of said upstream stand so that a detected tension coincides with a reference tension prescribed so as to decrease from a magnitude during steady-state rolling down to zero or a trace magnitude until said connecting point reaches said upstream stand after said connecting point has reached the position just before said upstream stand and so that said detected tension coincides with zero or a trace reference tension until said connecting point passes through said downstream stand after said connecting point has reached said upstream stand.

2. The method of controlling the hot strip finishing mill according to claim 1, wherein an ith stand roll peripheral speed manipulated variable ($V\Delta_R/V_R{}^L$) for making a mass flow variation zero is calculated by the following formula:

$$\left(\frac{\Delta V_R}{V_R{}^L}\right)_i = \left(\frac{\Delta V_R}{V_R{}^L}\right)_{i+1} + \left(\frac{\Delta h}{h^L}\right)_{i+1} - \left(\frac{\Delta H}{H^L}\right)_{i+1} +$$

-continued $$\left(\frac{\Delta f}{1+f^L}\right)_{i+1} - \left(\frac{\Delta f}{1+f^L}\right)_i$$

where i, i+1, are the adjacent stands, L is the reference value, Δ is the symbol representing a variation, $V_R$ is the roll peripheral speed, h is the delivery side thickness, H is the entry-side thickness, and f is the forward slip.

3. The method of controlling the hot strip finishing mill according to claim 1 or 2, wherein when detecting a tension of said rolled material on the basis of the actual values of said rolling force and of said rolling torque, an ith stand torque arm coefficient $A_{0i}$ is calculated by substituting, into the following formula, an actual value detected at a timing when said connecting point reaches the entry side of said ith stand:

$$A_{Oi} = \frac{G^{Mi} - \delta_i \cdot T^{Mi-1} + \gamma_i + T^{Mi}}{P^{Mi} - \beta_i \cdot T^{Mi-1} + \alpha_i + T^{Mi}}$$

where i, i+1 are the adjacent stands, M is the symbol representing an actual value, G is the rolling torque, P is the rolling force, $\alpha$, $\beta$, $\gamma$, $\delta$ are the constants, $T_i$ is the tension between the ith and (i+1)th stands, and $T_{i-1}$ is the tension between an (i−1)th and ith stands, and wherein a rolled material tension Ti between the ith and (i+1)th stands is calculated by substituting said torque arm coefficient into the following formula:

$$T_i = \frac{G^{Mi} - A_{Oi} \cdot P^{Mi} - A_{Oi} \cdot \beta_i \cdot T^{Mi-1} - \delta_i \cdot T^{Mi-1}}{A_{Oi} \cdot \alpha_i - \gamma_i}.$$

* * * * *

UNITED STATES PATENT AND TRADEMARK OFFICE

CERTIFICATE OF CORRECTION

PATENT NO. : 5,404,738
DATED : April 11, 1995
INVENTOR(S) : Kunio SEKIGUCHI

It is certified that error appears in the above-indentified patent and that said Letters Patent is hereby corrected as shown below:

On the title page, Item [73], the Assignee's city should read:

--Kawasaki, Japan--

Signed and Sealed this

Thirteenth Day of June, 1995

*Attest:*

*Attesting Officer*

BRUCE LEHMAN

*Commissioner of Patents and Trademarks*